US008100297B1

(12) United States Patent
Anish et al.

(10) Patent No.: US 8,100,297 B1
(45) Date of Patent: Jan. 24, 2012

(54) LOCKING CONTAINER CAP AND DISPENSER FOR FUEL

(76) Inventors: Gerald Anish, West Palm Beach, FL (US); Paul Berman, Santa Monica, CA (US); Rob Lefler, Ventura, CA (US)

( * ) Notice: Subject to any disclaimer, the term of this patent is extended or adjusted under 35 U.S.C. 154(b) by 359 days.

(21) Appl. No.: 12/322,448

(22) Filed: Feb. 3, 2009

Related U.S. Application Data

(60) Provisional application No. 61/063,395, filed on Feb. 4, 2008.

(51) Int. Cl.
*B67B 1/00* (2006.01)

(52) U.S. Cl. ..... 222/153.03; 220/210

(58) Field of Classification Search ..... 222/153.01–153.04, 152, 530, 222/538, 539, 556–570; 220/210, DIG. 23, 220/DIG. 33; 215/207, 228
See application file for complete search history.

(56) References Cited

U.S. PATENT DOCUMENTS

| | | | | | |
|---|---|---|---|---|---|
| 245,047 | A * | 8/1881 | Banker | 222/539 |
| 2,736,469 | A * | 2/1956 | Stone | 222/529 |
| 2,820,565 | A * | 1/1958 | Oberle | 215/207 |
| 2,974,836 | A * | 3/1961 | Gersten | 222/539 |
| 3,426,932 | A * | 2/1969 | Rouse | 215/207 |
| 4,028,914 | A | 6/1977 | Saele et al. | |
| 4,342,208 | A | 8/1982 | Evans | |
| 4,426,027 | A * | 1/1984 | Maynard, Jr. | 222/529 |
| 4,527,407 | A * | 7/1985 | Shanklin | 70/167 |
| 4,595,130 | A * | 6/1986 | Berney | 222/539 |
| 4,640,446 | A * | 2/1987 | Walker | 222/416 |
| 4,754,627 | A * | 7/1988 | Butler, III | 70/158 |
| 4,811,865 | A | 3/1989 | Mueller, Jr. et al. | |
| 4,830,225 | A * | 5/1989 | Heimlich | 222/153.03 |
| 4,984,698 | A | 1/1991 | Stuckey | |
| 5,392,816 | A * | 2/1995 | Hagenberg et al. | 138/89 |
| 6,036,061 | A * | 3/2000 | O'Donnell | 222/539 |
| 6,223,923 | B1 * | 5/2001 | Fishman | 220/210 |
| 6,863,098 | B2 * | 3/2005 | Chrisco et al. | 141/286 |

* cited by examiner

*Primary Examiner* — Lien Ngo
(74) *Attorney, Agent, or Firm* — Harpman & Harpman

(57) ABSTRACT

A locking gasoline cap and integrated portable container to restrict unauthorized access and removal of the container and contents. An outer freely rotating cap is selectively engaged by a key locking cylinder to an inner fluid sealing access cap. A reversible pour spout provides for direct fluid transfer from the container after unlocking and repositioning. A static security cable links the locking cap with the container and an immovable object attachment point therebetween.

2 Claims, 7 Drawing Sheets

LOCKING CONTAINER CAP AND DISPENSER FOR FUEL

This application claims benefit of U.S. Provisional Application No. 61/063,395, filed Feb. 4, 2008.

BACKGROUND OF THE INVENTION

1. Technical Field

This device relates to locking caps and closures that allow the user to secure access to fluid storage sources.

2. Description of Prior Art

Prior art devices of this type have been directly primarily to locking gas caps that are typically found on automobiles or commercial vehicles such as trucks and heavy equipment. Such devices usually have a cap that locks to the gas filler pipe so that a key must be used to gain access to same, see for example U.S. Pat. Nos. 4,028,914, 4,342,208, 4,811,865 and 4,984,698.

In U.S. Pat. Nos. 4,028,914, 4,984,698, and 4,342,208 all have a lockable closure cap showing three different structural ways to lock a cap on a fluid outlet.

U.S. Pat. No. 4,811,865 illustrates a cap and spout assembly with a strap that attaches to a locking mechanism to prevent removal of the cap therefrom.

SUMMARY OF THE INVENTION

A multiple phase locking gasoline cap on a portable liquid container. The cap provides for keyed lock that allows for interengagement of an outer cap with an inner fluid sealing access cap for rotation of same. The interengaging security cable extends from the cap to around the neck of the container so that when locked thereon the cable can encircle an adjacent fixed element preventing the container from being moved without unlocking the cap. A removable pour spout is threadably disposed within the cap configuration to form a liquid tight seal when in stored or deployed pour position.

DETAILED DESCRIPTION OF THE INVENTION

Figure 1:
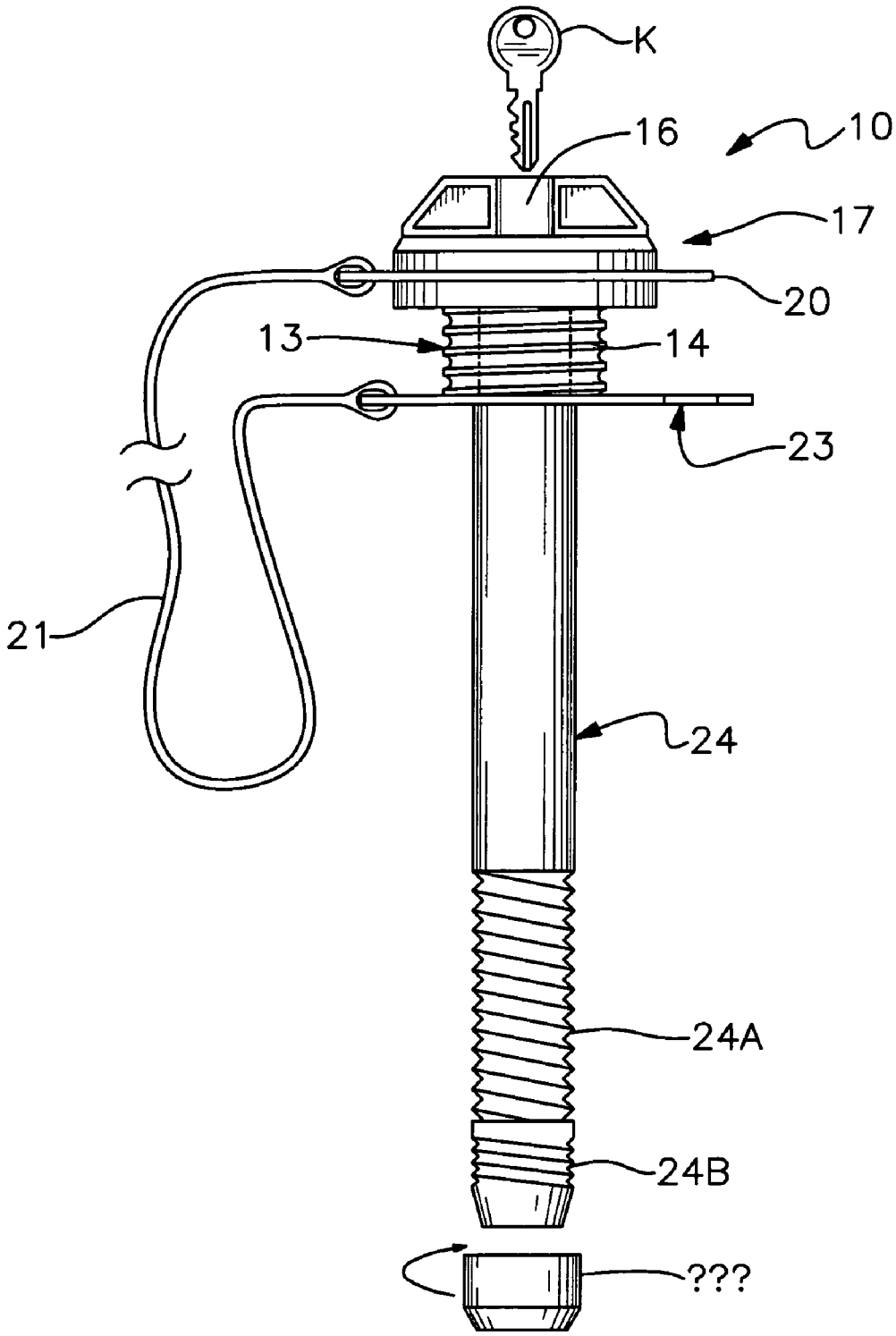
FIG. 1 is a side elevational view of the primary form of the invention.

Referring to FIGS. 1-4 of the drawings, locking gas caps 10 and 11 of the invention and a container 12 can be seen defining a primary and alternate form of the invention respectively.

The primary cap 10 has a container engagement body member 13 with an internal and exterior threaded sleeve 14 extending therefrom, having an annular cap engagement portion 15. A keyed cylinder locking assembly 16 is mounted in a hand engagement cap portion 17 that is in turn rotatably retained over the hereinbefore described container engagement body member 13. The cylinder lock assembly 16 has a selectively extending elements 18 that locks into a corresponding receiving key way 19 in the top of the container engagement body member 13 when the lock assembly is in the unlocked position activated alternately by a key K.

A cable retainment ring 20 is secured about the exterior of the container engagement body member 13 with a cable 21 extending therefrom as will be described in greater detail hereinafter.

The free end of the cable 19 has a container engagement ring 22 with a nozzle cap retainer fitting 23 extending therefrom.

Figure 5:
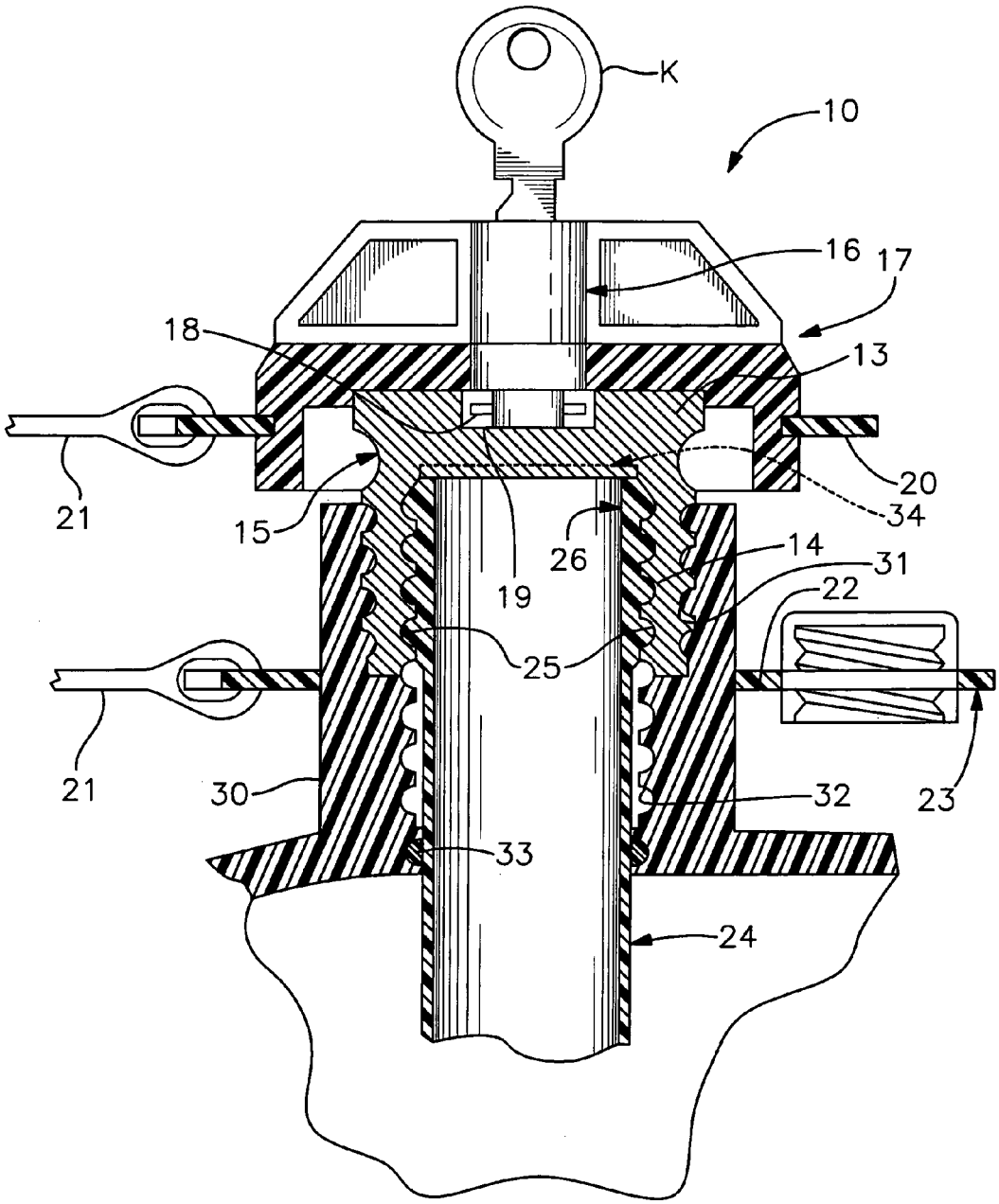
FIG. 5 is a cross-sectional view of the primary form of the invention.

A reversible dispensing nozzle 24 is threadably retained within the threaded sleeve 14 of the cap 10 having exterior threads 25 extending inwardly from its threaded end 26 as best seen in FIG. 5 of the drawings.

Figure 3:
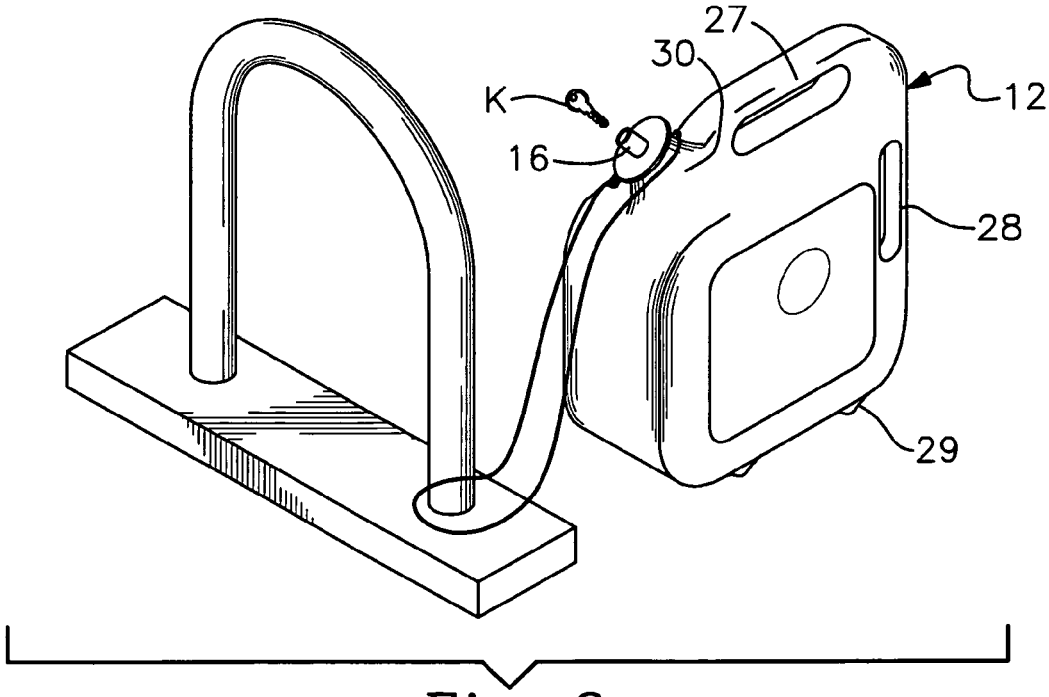
FIG. 3 is a graphic perspective illustration of a gas container and cap of the invention secured to a retainment barrier.
Figure 4:
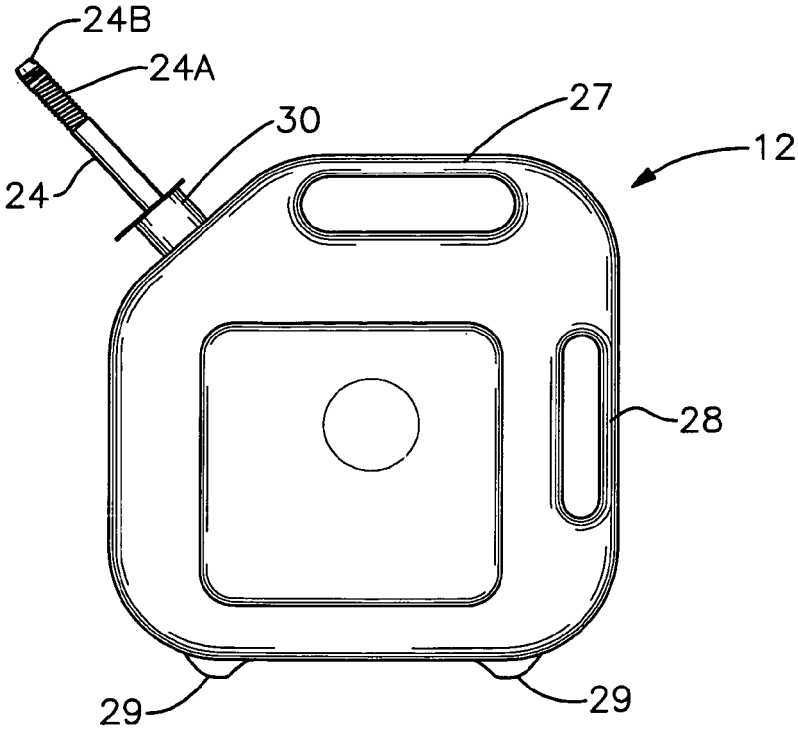
FIG. 4 is a side elevational view of the gas container with the cap spout of the invention inserted therein for use.

The container 12 of the invention as seen in FIGS. 3 and 4 of the drawings has two angularly disposed handles 27 and 28 formed therein and multiple molded stabilization support feet 29 on its bottom surface as will be well understood by those skilled in the art. A molded outlet neck 30 extends from the container's upper surface adjacent the handle 27.

The neck 30 as best seen in FIG. 5 of the drawings has a pair of independent internal threaded fields at 31 and 32. The first of which at 31 is of a larger diameter and threadably receives the exterior threads on the cap sleeve 14 which correspondingly retains the dispensing nozzle 24 therewithin as noted.

In closed locked position, the cap 10 on the neck 30, the dispensing nozzle 24 forms a first liquid seal with the container 12 by engaging an annular sealing ring 33 at the internal base of the container neck 30 and the cap portion 17 is free to rotate about the container engagement body member 13.

A second liquid seal is formed by the threaded engagement of the nozzle 24 against the internal surface of the cap portion 32 which may have a sealing gasket 34 positioned within a recess, if required, indicated specifically by broken lines.

Figure 6:
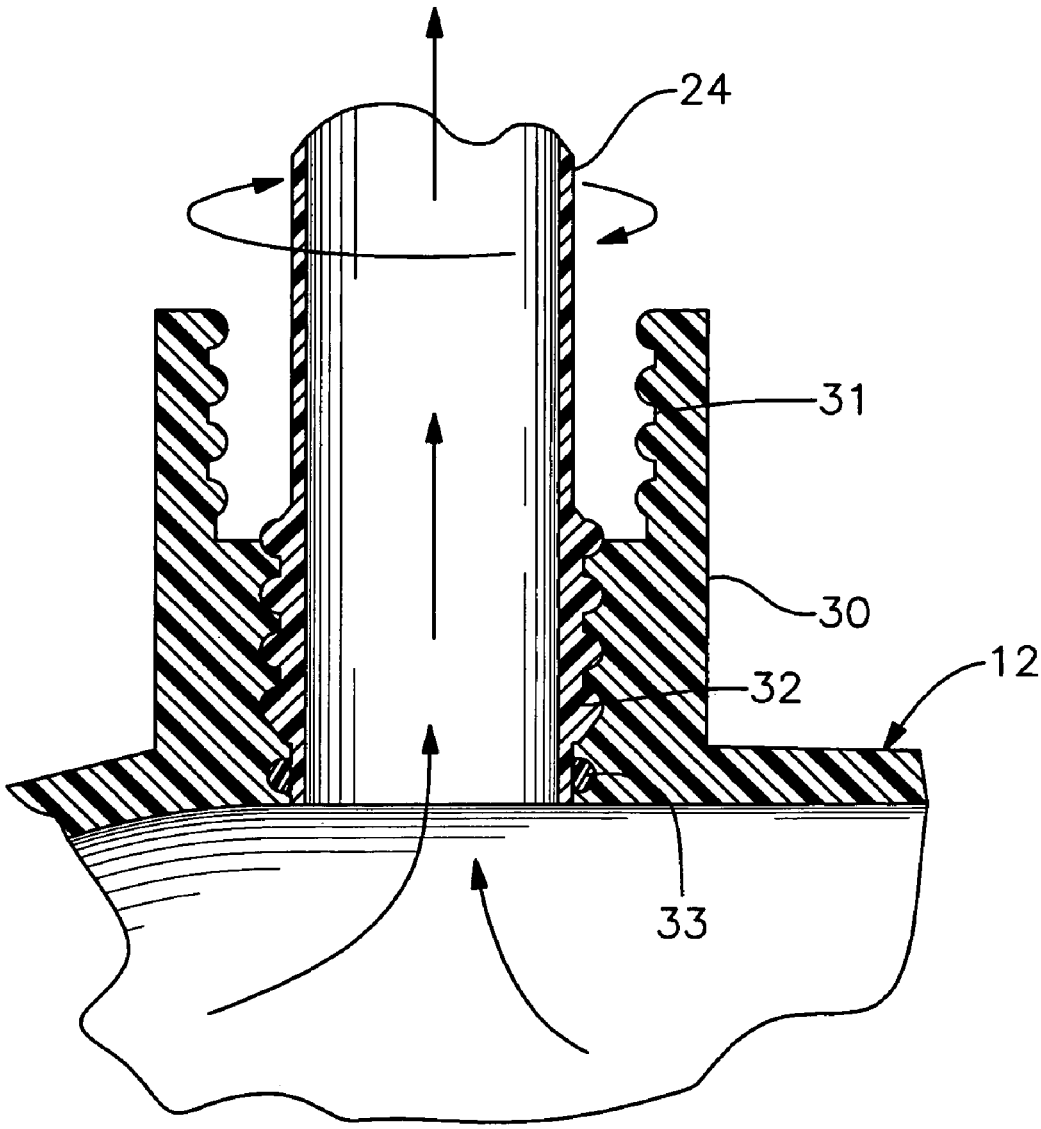
FIG. 6 is a cross-sectional view of the primary form of the invention with spout deployed on the dedicated container.

As seen best now in FIG. 6 of the drawings, the cap 10 has been removed from the neck 30 by unlocking of the locking assembly 16 engaging the respective cap portions for removal from the container 12 with the nozzle 24 removed and reversed and threadably engaged within the container neck 30, second thread field 32. The gasket ring 33 again defines a liquid seal therebetween for use access dispensing as generally illustrated in FIG. 4 of the drawings.

The nozzle 24 has a flexible bellows portion 24A with a threaded end portion 24B for threadably receiving a nozzle cap 35 which when not in use is retained in the hereinbefore described cap holder 23.

Figure 2:
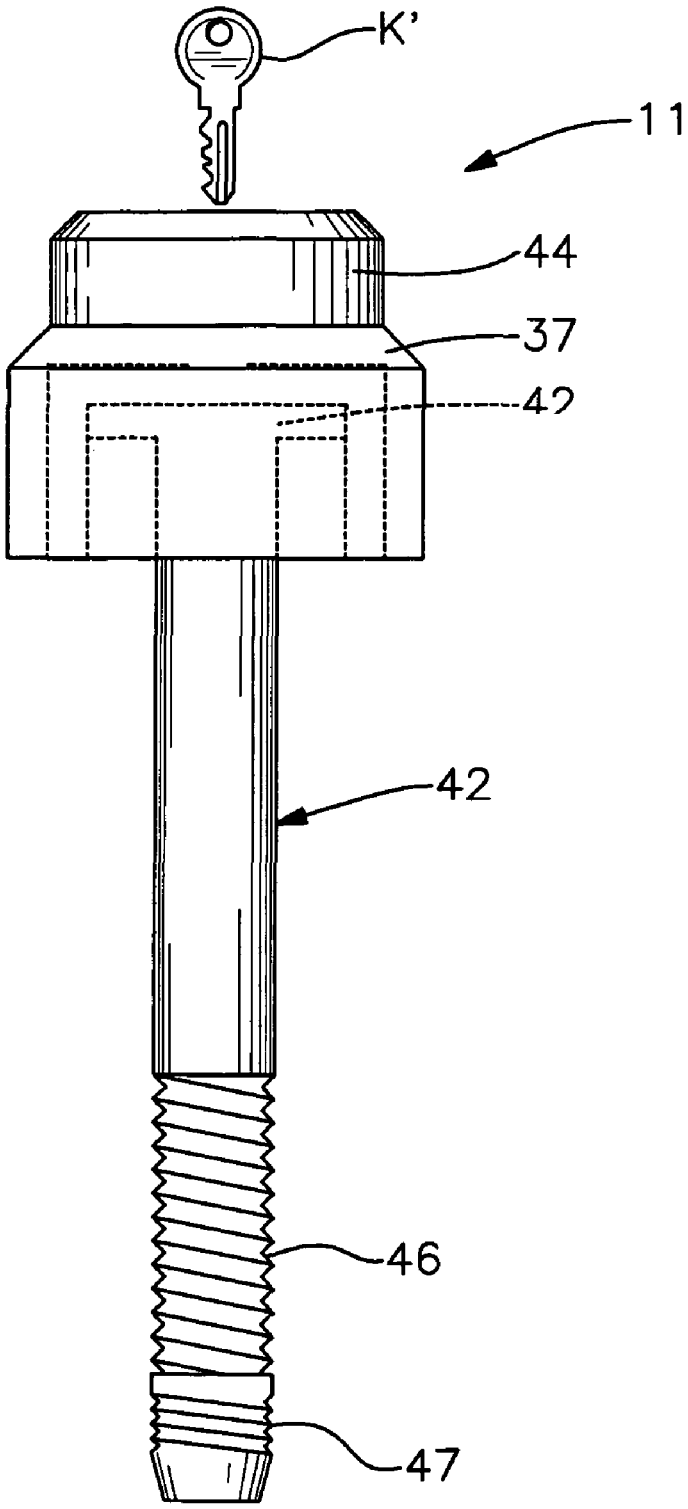
FIG. 2 is a side elevational view of an alternate form of the invention.
Figure 7:
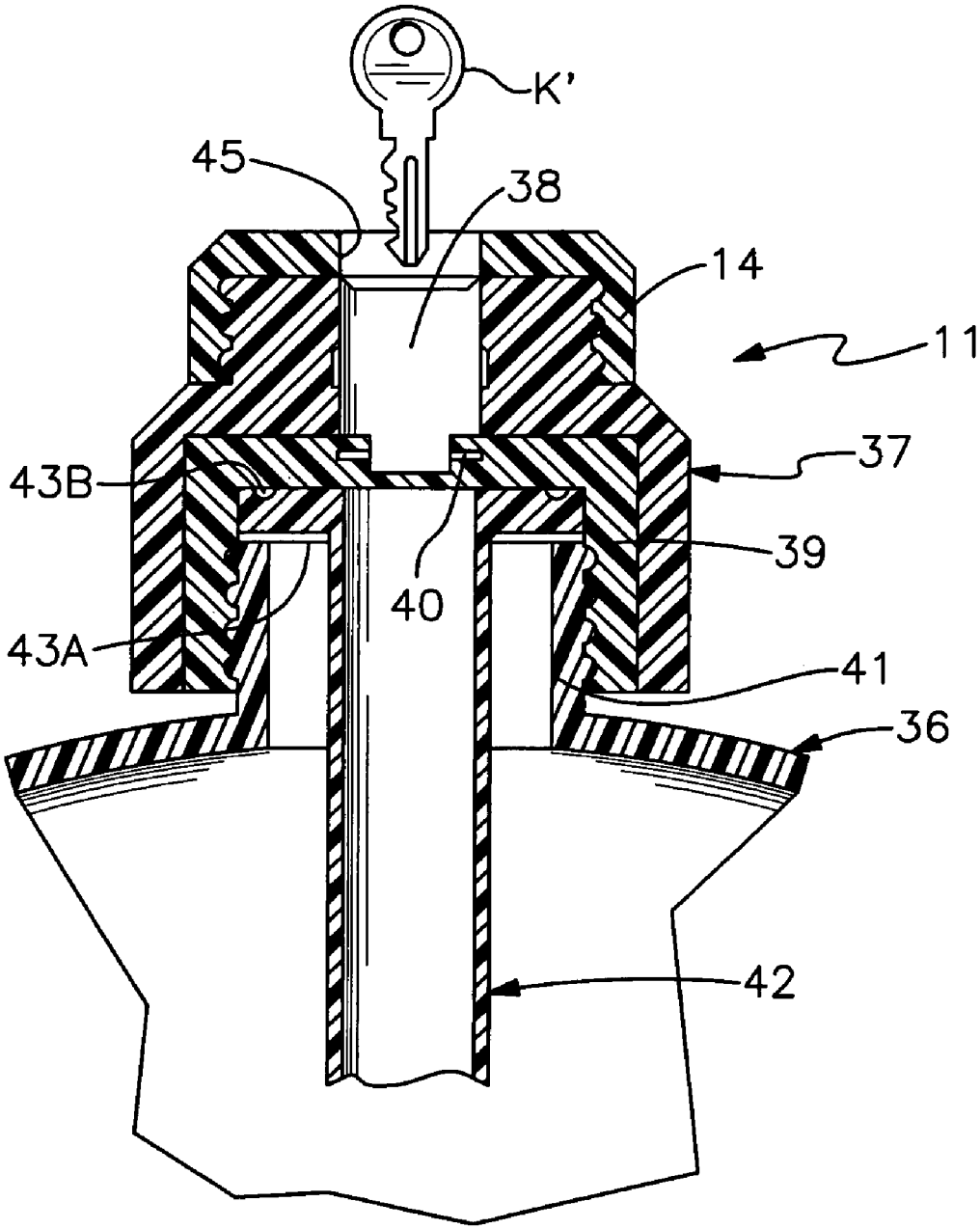
FIG. 7 is a cross-sectional view of the alternate form of the invention.
Figure 8:
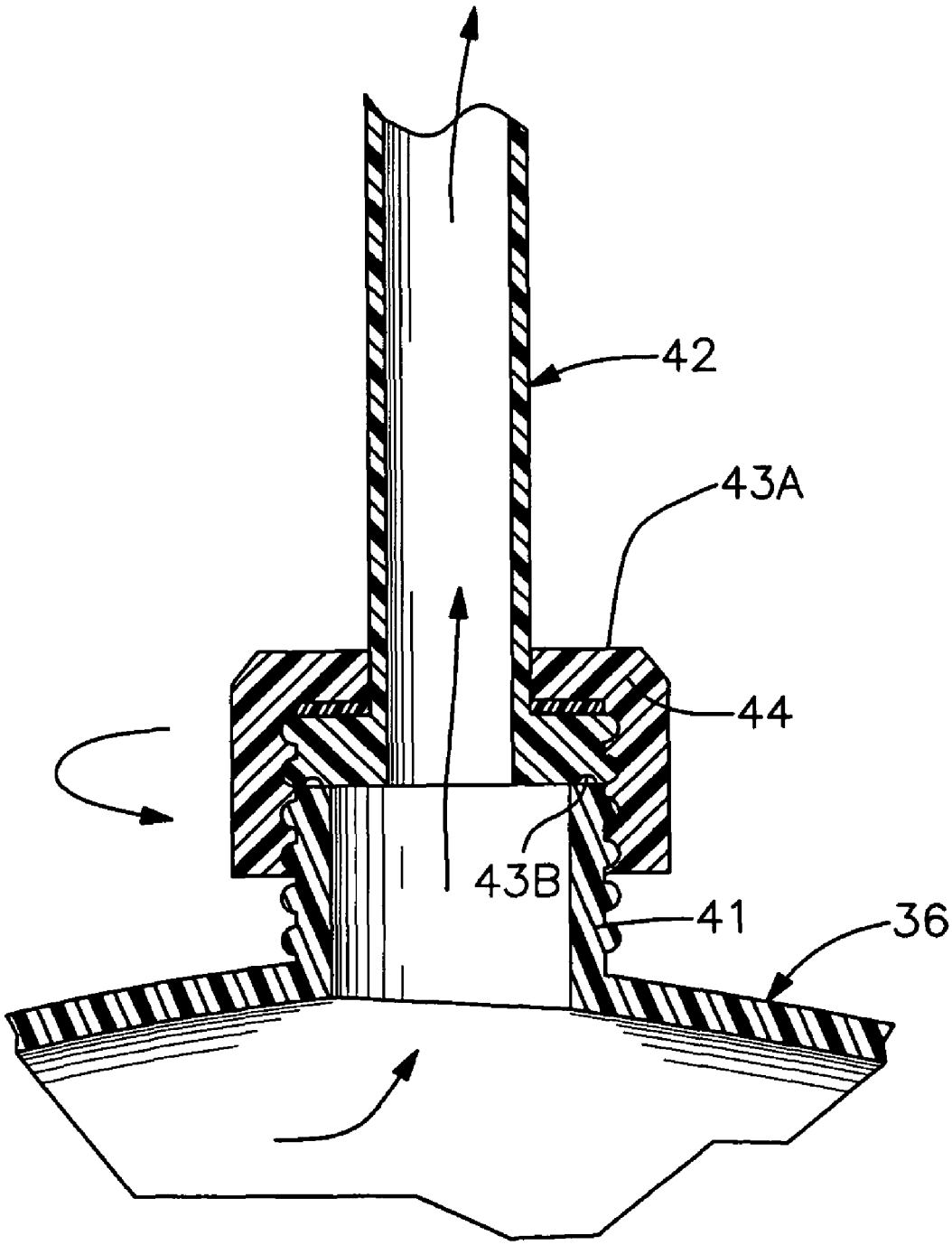
FIG. 8 is a cross-sectional view of the alternate form of the invention with the pour spout deployed on a standard gasoline container.

Referring now to FIGS. 2, 7 and 8 of the drawings, the alternate locking gas cap 11 of the invention can be seen which can be used on any existing portable gas container illustrated generally at 36. The alternate cap 11 has a main annular cap member 37 with a cylinder locking assembly 38 mounted centrally therein.

An inner independently rotatable sealing container cap portion 39 is selectively engaged by the cylinder lock assembly 38 via an engagement element 40 so as to engage the cap portion 39 to the cap member 37 allowing for rotation removal or replacement on the neck 41 of the standard gasoline container 36 or the like.

A pour nozzle 42 is stored within the neck 36 held in place by the inner cap portion 39 with sealing gaskets 43A and 43B.

An annular nozzle retainment fitting 44 is threadably disposed on the cap member 37 having a central aperture at 45 therein allowing access to the cylinder lock assembly 30 by a key K'.

In use, it will be seen that once unlocked via the key K' the inner sealing cap portion 39 can be rotated by the outer cap member 37 removing same from the container. The nozzle 42 is then removed and inverted and placed through the apertured nozzle retainment fitting 44, now removed, and repositioned on the container neck 41 as seen in FIG. 8 of the drawings for pour access of the fluid therewithin indicated by directional fluid arrows.

It will be evident from the above description that in the primary form of the invention the locking cap 11 with its integrated attached cable 21 will extend from the cap around a fixed element FE and back to the container's neck 30 so as to prevent the container 12 from being removed as illustrated generally in FIG. 3 of the drawings.

It will thus be seen that multiple gasoline or fluid locking cap assemblies have been illustrated and described and it will be apparent to those skilled in the art that other limited access locking cap configurations can be used such as containers without nozzle requirements as in control medical substances available by prescription for example. It can also be adapted to a true child resistance closure which may be needed with certain pharmaceutical compounds available in liquid form. Therefore various changes and modifications may be made therein without departing from the spirit of the invention. Therefore I claim:

The invention claimed is:

1. In combination, a locking cap and container for fuel, said cap comprising a cap body, a container engagement sleeve rotatably retained within and extending from said cap body, said engagement sleeve having internal and exterior threads arranged for registration in and on a neck on said container in sealing relation thereto, a hand engagement cap portion of said cap, a keyed lock on said cap selectively engaging said container engagement sleeve for selective rotation thereof, an open neck extending from said container, said neck having a first interior threaded field and a second interior threaded field of a reduced annular dimension from said first threaded annular field, a dispensing nozzle threadably engaged in sealing relation within said container engagement sleeve.

2. The combination locking cap and container for fuel of claim 1 wherein a cap retainment cable extending from said cap body, an engagement ring on said container neck and said free end of said cap retainment cable.

* * * * *